US005417421A

United States Patent [19]

Bagley

[11] Patent Number: 5,417,421

[45] Date of Patent: May 23, 1995

[54] GAME APPARATUS

[76] Inventor: Daniel J. Bagley, P.O. Box 1230, North Bay, Ontario, Canada, P1B 8J1

[21] Appl. No.: 142,945

[22] Filed: Oct. 29, 1993

[51] Int. Cl.[6] ..... A63B 67/00; A63F 7/06

[52] U.S. Cl. ..... 273/108; 273/118 R; 273/126 R; 273/57.2; 273/85 R

[58] Field of Search ..... 273/108, 118, 126 R, 273/7, 57.2, 85 R

[56] References Cited

U.S. PATENT DOCUMENTS

| | | | |
|---|---|---|---|
| 709,144 | 9/1902 | Edgerly | 273/85 R |
| 3,202,427 | 8/1965 | Patent | 273/126 R |
| 3,640,535 | 2/1972 | Gendler | 273/126 R |
| 3,825,264 | 7/1974 | Dockum | 273/126 R |
| 4,018,443 | 4/1977 | Bird | 273/85 R |
| 4,560,163 | 12/1985 | Erickson | 273/85 R |
| 4,775,152 | 10/1988 | Roehl | 273/118 R X |
| 4,854,589 | 8/1989 | Davis | 273/85 R X |
| 4,995,611 | 2/1991 | Goldthorpe | 273/126 R X |
| 5,029,863 | 7/1991 | Krawczyk et al. | 273/118 R X |
| 5,074,556 | 12/1991 | Loeppky et al. | 273/126 R X |

FOREIGN PATENT DOCUMENTS

| | | | |
|---|---|---|---|
| 2520627 | 8/1983 | France | 273/108 |

OTHER PUBLICATIONS

The New York Time, "Hockey Game of Fun", p. S25 (11 Dec. 1966).

"8 Great Gifts from Your Workshop", Mechanix Illustrated, (Dec. 1984) pp. 61-62.

*Primary Examiner*—Raleigh W. Chiu

[57] ABSTRACT

A game apparatus defines a raised playing surface having boards thereabout which allows for playing a game having some of the attributes of hockey without the specialized equipment and facilities. The game can be played by two individuals and provides aggressive interaction with no body contact. Playing of the game provides excellent physical activity and good hand-eye coordination.

20 Claims, 4 Drawing Sheets

FIG. 1.
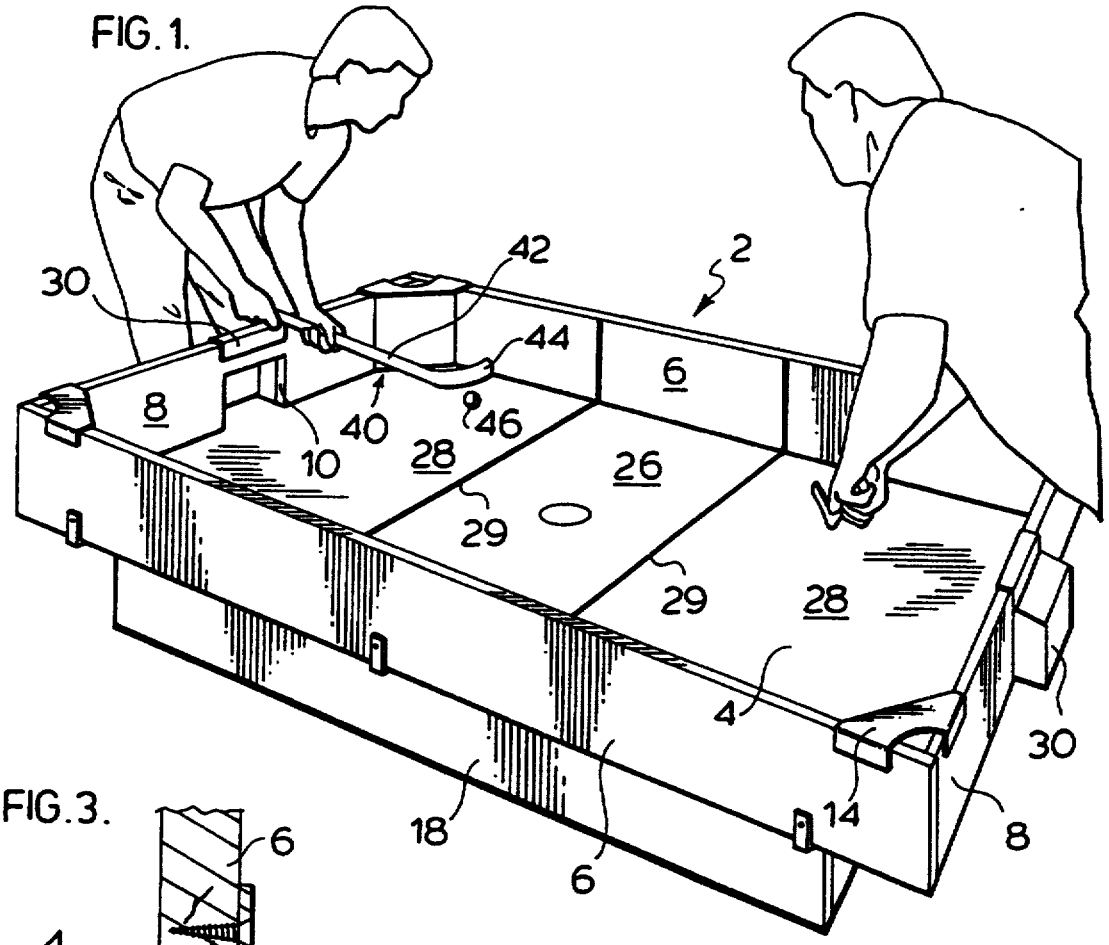
FIG. 3.
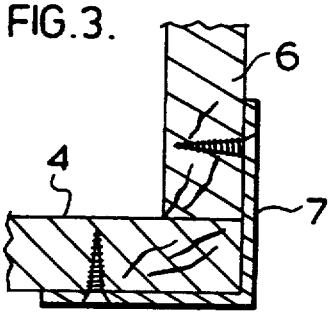
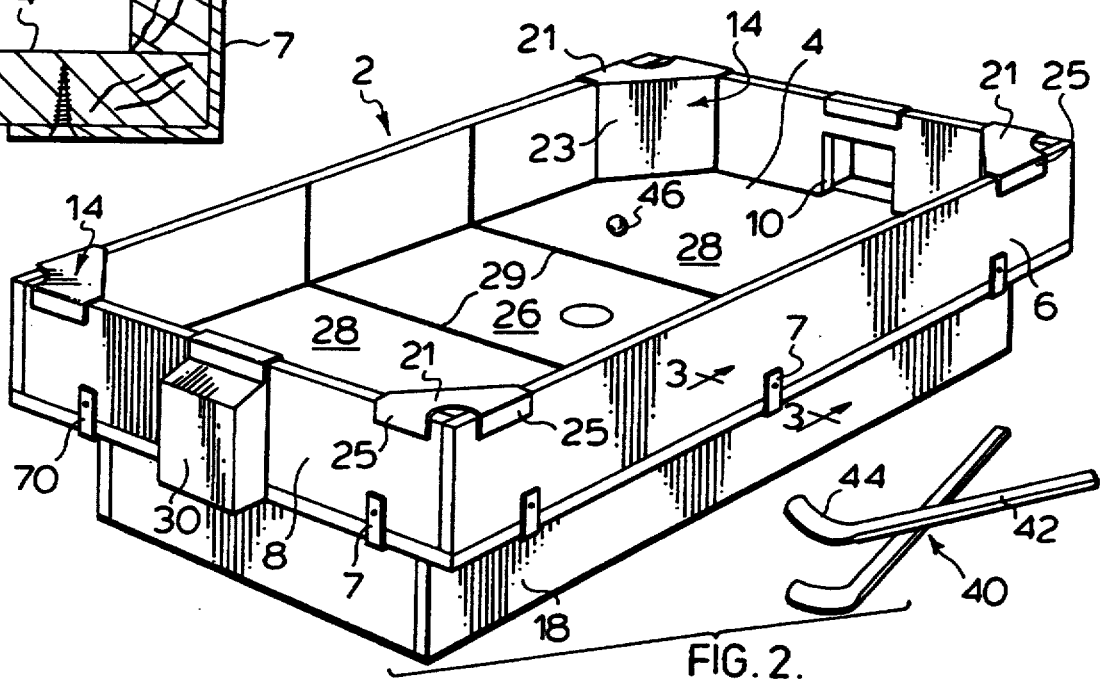
FIG. 2.

FIG. 5.
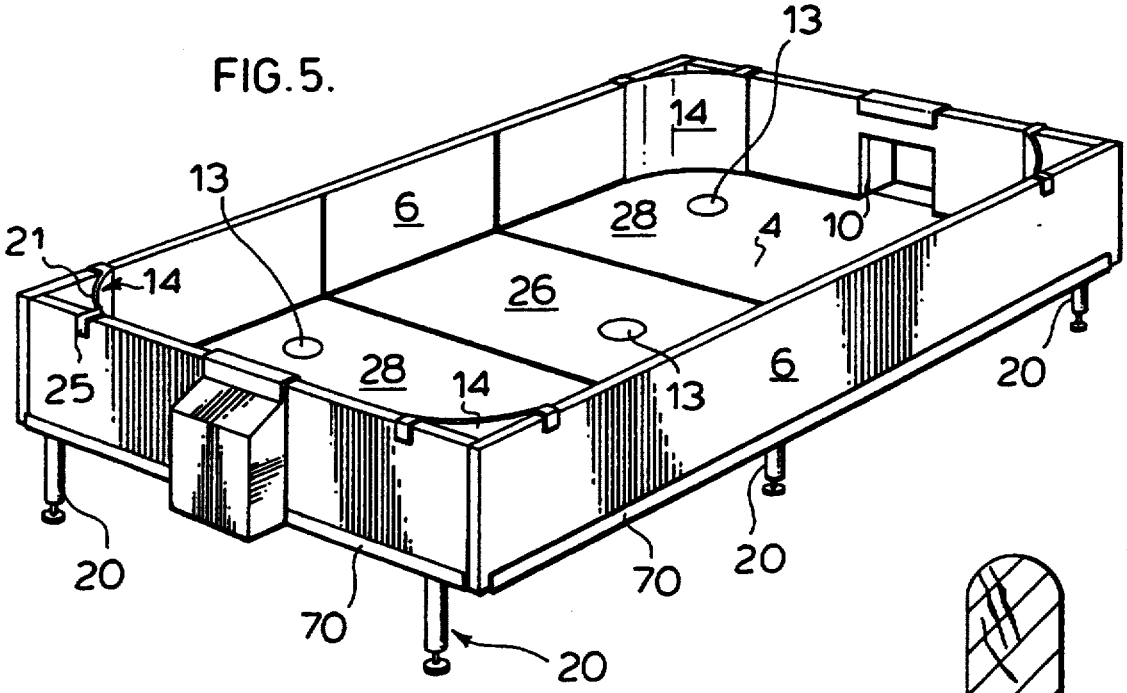
FIG. 7.
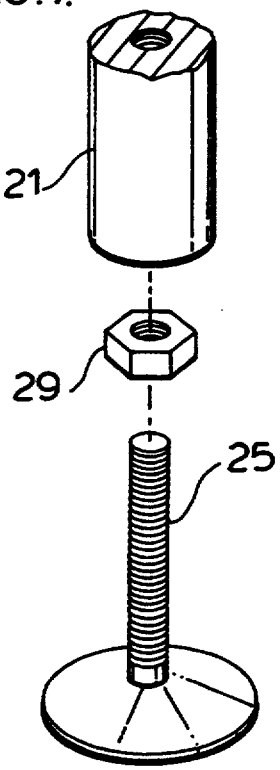
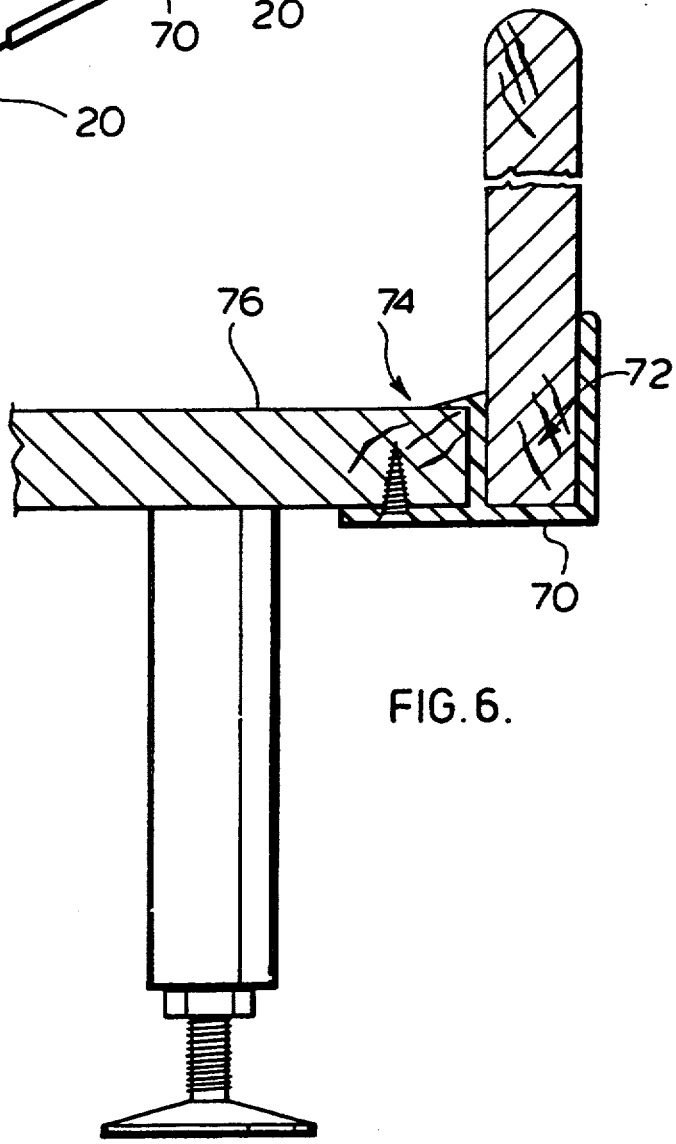
FIG. 6.

FIG. 8.
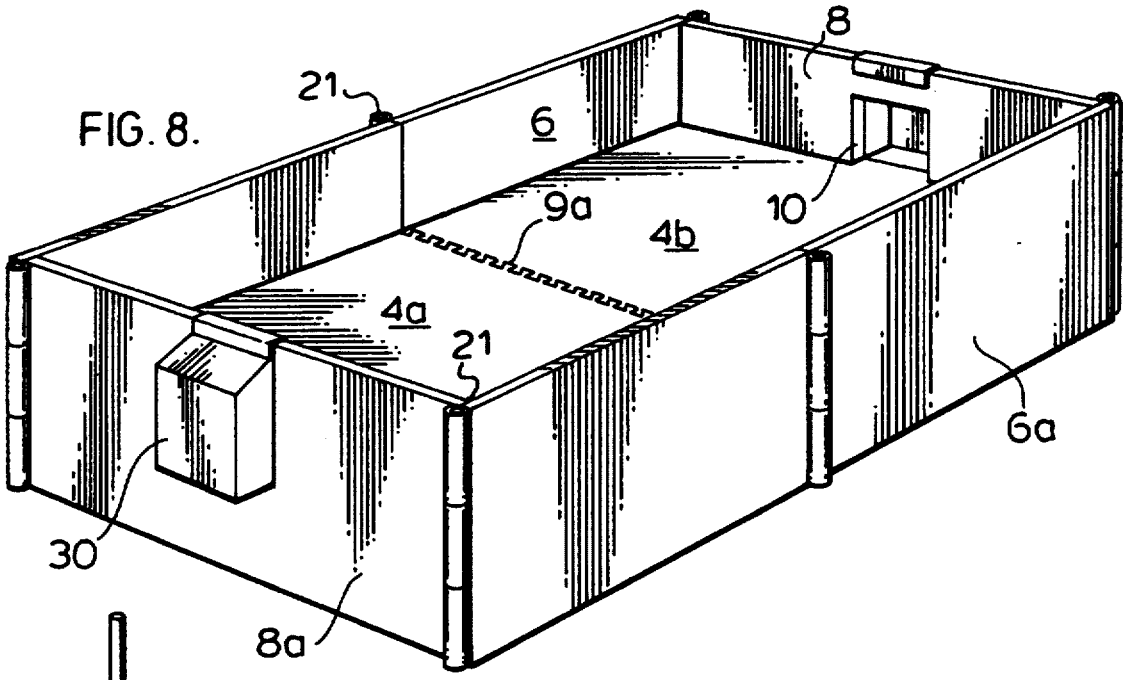
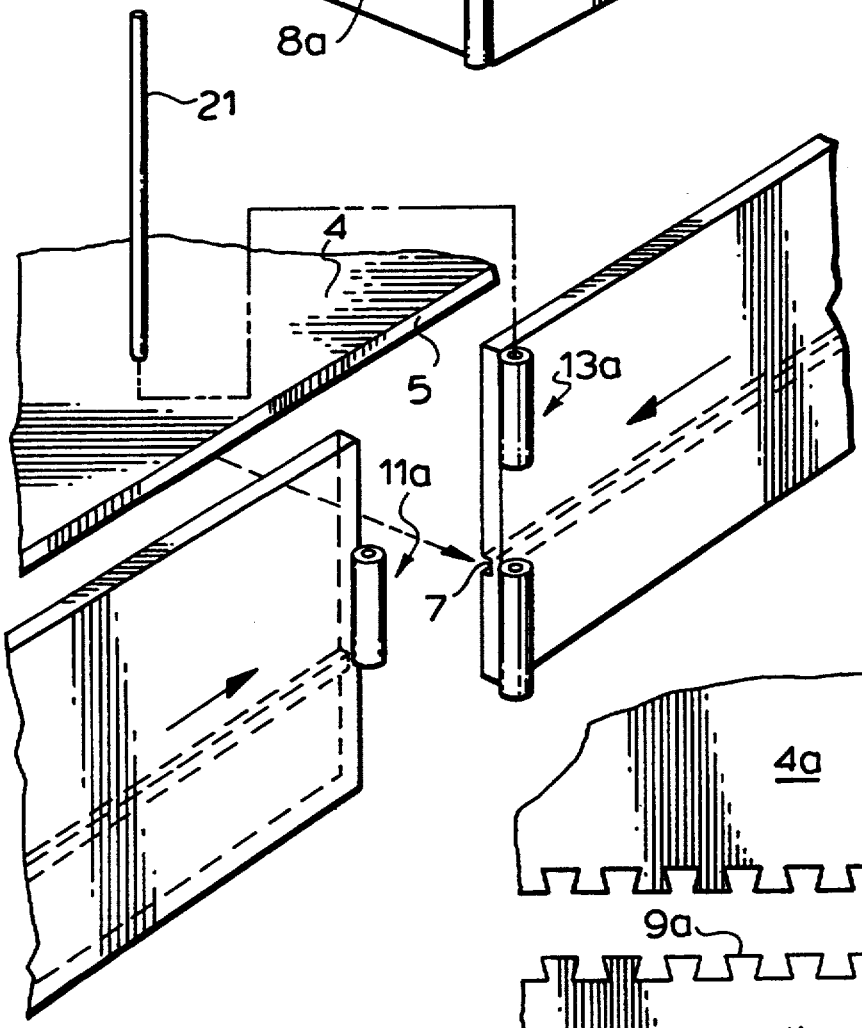
FIG. 9.
FIG. 10.
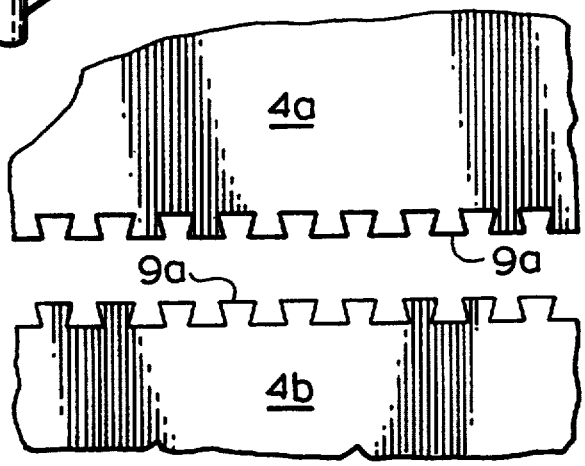

GAME APPARATUS

FIELD OF THE INVENTION

The present invention relates to a game apparatus.

BACKGROUND OF THE INVENTION

Over the last number of years, there has been a resurgence in games, and in particular, games that can be played at home. In addition, people have recognized that it is important to maintain a certain minimum level of physical activity and they have devoted a significant portion of their leisure time to such physical activity. Parents continue to recognize that it is also important to provide children and teenagers with various activities to productively occupy their time.

In Canada and the northern United States, hockey is extremely popular, however, it does require considerable equipment and a large group of players to be played in a meaningful way. Furthermore, it is generally a winter activity and cannot be typically played at home. Hockey does develop motor skills, in particular it develops good hand and eye coordination, and is a very good form of physical exercise. Unfortunately, there is a wide variance in skill levels between the players of the same age as well as a divergence in skill levels with age. Furthermore, hockey is generally played by males or females and is not generally considered a co-op game.

SUMMARY OF THE INVENTION

According to the present invention, it is possible to play a game at home, either indoors or outdoors, which has many of the positive aspects of hockey while being cost effective, can be played by both genders and can be played by a variety of individuals of different ages. In particular, the game can be played by families and friends of all ages.

The game apparatus is relatively easy to assemble and can be conveniently stored.

A game apparatus according to the present invention comprises a game surface closed at the sides and ends by upstanding board members with the game surface being divided into two opposed sections, with each section having a goal area to be defended. The goal area is preferably defined by a port in the upstanding board members.

The game apparatus according to an aspect of the invention includes at least two playing sticks, with each playing stick having an elongate shaft and a short blade portion at one end thereof. A playing piece (preferably readily compressible) is provided and sized to easily pass through the goal areas and to be moved and directed by the playing sticks. Players are located exterior to the playing surface. (Each player stands behind his or her net and preferably cannot stand or move up along board area.

According to an aspect of the invention, the game apparatus is such that the game surface is raised from a ground level to a height greater than 6 inches and less than 2 feet. A height of 9 inches to 2 feet is preferable; a height of 12 to 16 inches is further preferred.

According to yet a further aspect of the invention, the playing piece is a ball and preferably a hollow, readily compressible rubber ball, such as a squash ball. Both slow and fast squash balls are suitable.

According to yet another aspect of the invention, players of the game use one of the sticks for directing the playing piece towards the other player's goal and the players are positioned exterior to the game surface and preferably are limited to a region beyond the end of the game surface.

According to yet another aspect of the invention, the blade portion of each stick is of a length of about 4¼ inches. The shaft of the stick is preferably less than three feet and a length of about two feet has proven satisfactory. The length is such to allow both hands of a user to engage the stick in spaced relationship.

According to yet a further aspect of the invention, the game surface is divided into three regions, each of which extends across the game surface. The three regions comprise a defensive region adjacent each goal and a common central region therebetween. The rules of the game are such that each player keeps his stick in motion within his own defensive region or within the common central region. Once outside his/her own defensive region, a player may rest their stick. Two hands are maintained on the playing stick at all times.

According to yet a further aspect of the invention, the game apparatus includes a net associated with each goal and supported from the end board to the exterior thereof, with the net defining a retaining pocket for the playing piece should it enter the respective goal.

BRIEF DESCRIPTION OF THE DRAWINGS

Preferred embodiments of the invention are shown in the drawings, wherein:

FIG. 1 shows a perspective view of the game apparatus;

FIG. 2 shows additional details of the game apparatus;

FIG. 3 is a sectional view along line 3—3 of FIG. 2;

FIG. 5 is a perspective view of an alternate structure of the game apparatus;

FIGS. 6 and 7 show details of the leg support used in FIG. 5;

FIG. 8 is a perspective view of an alternate game structure;

FIG. 9 is a partial perspective showing assembly of the side boards and playing surface used in the structure of FIG. 8; and FIG. 10 is a partial top view showing joining of two sections of the playing surface of the structure of FIG. 8.

DETAILED DESCRIPTION OF THE PREFERRED EMBODIMENTS

Figure 4:
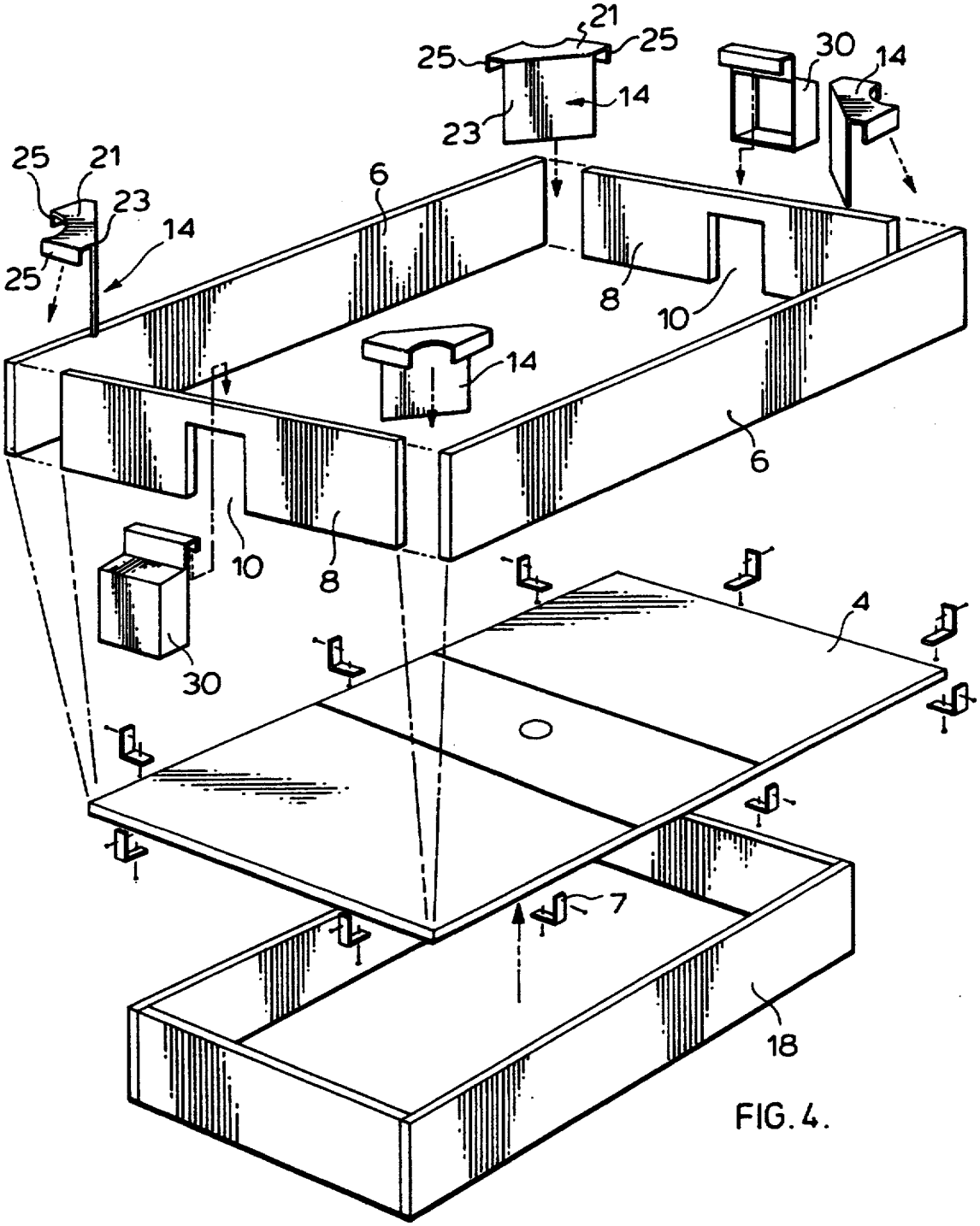
FIG. 4 is an exploded perspective view of the playing surface of the game apparatus.

The game apparatus 2 has a playing surface 4 closed at the periphery thereof by side boards 6 and end boards 8. Each of the end boards 8 have a cutout 10 which defines a goal to be defended by the player. Preferably, the game apparatus also includes angled corner members 14, however, the apparatus can be formed as part of the side and end boards in a molding operation, if desired.

The playing surface 4 and boards 6 and 8 are held in position by 'L' brackets 7 mechanically fastened by screws. The 'L' brackets are appropriately located about the side and end boards.

The playing surface 4 is at an elevated level of between approximately 6 inches and 2 feet, and preferably between 6 and 18 inches to reduce the distance between the players' hands and the playing surface. The playing surface 4 is supported at the raised position by a base 18 or by legs 20 (see FIG. 5) which are conveniently attached below the playing surface.

The playing surface 4 is divided into a central region 26 having a defensive region 28 to either side thereof. Thus, each player would defend one of the goals in the end boards 8 and a defensive region is provided adjacent this goal region. The central region 26 is a common area where the player may use his stick to try to direct the ball towards the other player's goal. Each defensive region is marked by a boundary 29 on the playing surface 4.

Each playing stick 40 has a shaft 42, similar to a hockey stick shaft, and a short blade portion 44. The blade portion is of a length of about 4¼ inches and of a height of approximately 3 inches. The shaft 42 is preferably of a length less than three feet and a length of two feet has proven satisfactory. It has been found that this size of blade and shape of the playing stick allows skills acquired from playing hockey to be transposed in playing the game, and the reduced size of the blade makes it appropriate for the greatly reduced playing surface 4. The shaft of each stick is preferably less than 3 feet, and a length of two feet has proven satisfactory. The length of the shaft is such to allow both hands of a player to engage the stick in spaced relationship similar to engagement of an actual hockey stick. The players are limited to the area beyond their respective end board 8 and it has been found that it is most desirable to keep the area to the exterior of the side boards free. This makes the game more effective and reduces the space required to play the game.

The playing piece 46 is preferably a soft squash ball, but, in any event, is a readily compressible member. It has been found that a soft or slow squash ball is suitable, however, a hard, fast squash ball may be preferred by some players, particularly where greater speed is desired. The game apparatus is preferably approximately 4 feet wide and approximately 6 feet long. The size of the goal area is about 4¼ inches by 4¼ inches. The ports 10 preferably have a net portion 30 to define a closed pocket or to act as a soft retaining area, should the playing piece pass through the port.

FIGS. 1 through 7 show embodiments where the game apparatus can be primarily of wood. In particular, as shown in FIGS. 5 and 6, a plastic or aluminum extrusion 70 includes a first slot 72 for receiving a side board and a second slot 74 for receiving the base member. The playing surface is a plywood substrate 76 which is forced into the slot 74. The base and the sidewalls are preferably perpendicular.

The corner members 14 in FIGS. 1, 3, 4 and 5 also serve to reinforce the corner junction between the respective end board and side board. Each corner member includes a top gusset component 21, a face section 23 and board engaging flanges 25. These members are held by gravity and may easily be located for maintaining the perpendicular orientation of the boards.

The embodiment of FIGS. 6 and 7 include separate legs 20 spaced about the periphery of the game apparatus and at certain central locations. Each leg has a levelling foot which can be adjusted by threading into or out of the barrel 21. The upper end of the barrel engages the lower surface of the playing surface 4 and the levelling foot is held in position by the lock nut 29.

In addition to the ports 10, the game can include ports 13 provided in the playing surface 4. These ports can be closed by cap members inserted in the ports to provide a continuous playing surface 4. The purpose of the ports is to accommodate a different game similar to golf mini putting. The ball can be directed by the stick towards anyone of the ports 13 similar to a putting green. Various rules can be provided for this type of putting game, including a rule requiring the ball or playing piece to first strike a sidewall or endwall member before it can enter a port. In this way, the game apparatus can also be used for games other than the hockey like game described above.

The game has a fairly fast learning curve and allows a very competitive game, even with players of different abilities. First time players can easily play the game effectively and merely develop more sophisticated techniques and skills through use.

The embodiment of FIGS. 8 through 10 use side boards **6*a* and end boards 8*a*, each of which have a groove 7 for receiving an edge 5 of the playing surface 4 which has been divided into playing sections 4*a* and 4*b*. The center about edges 9*a*** have a dovetail connection for defining an accurate joint.

Each of the board members have a righthand connection **11*a* and lefthand connection 13*a*. These connections join and are held in connection by a pin 21 received in aligned right and lefthand connectors. The side boards 6*a* and end boards 8*a*** are of additional depth and cooperate to form the base for supporting the playing surface at a raised position.

The game apparatus allows for development of hand-eye coordination, provides good physical exercise and also allows either a very competitive or friendly environment for competing. The game is suitable for both males and females, and females can certainly compete on an equal basis with their male counterparts. The game can be played indoors or outdoors and the game is much safer than hockey. Furthermore, the game apparatus can be made inexpensively and can easily be assembled and stored.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A game apparatus for interactive competition between two opposed players comprising a game surface supported at a raised position at least six inches above ground level, said game surface being closed at the sides and ends by upstanding board members and being divided into at least two opposed sections with each section having a goal area to be defended, each goal area being defined by a port adjacent to said upstanding board members, at least two playing sticks with each playing stick having an elongate shaft of a length of about two feet or greater to allow both hands of a player to engage the shaft in spaced relationship with a short blade portion at one end thereof, and a playing piece sized to easily pass through said goal areas and to be moved and directed by said playing sticks.

2. A game apparatus as claimed in claim 1 wherein said playing piece is a hollow compressible rubber ball.

3. A game apparatus as claimed in claim 1 wherein said game surface is raised from ground level to a height greater than 9 inches and less than 2 feet.

4. A game apparatus as claimed in claim 1 wherein said playing piece is a ball.

5. A game apparatus as claimed in claim 3 wherein said playing piece is a hollow rubber ball and said game surface between said goal areas is of a length of about six feet.

6. A game apparatus as claimed in claim 1 wherein said sticks are used for directing the playing piece towards the other player's goal area and each stick is held by both hands of a user positioned behind a respective goal area.

7. A game apparatus as claimed in claim 6 including a player area behind each goal area where a player is restricted to stand during playing of said game apparatus.

8. A game apparatus as claimed in claim 6 wherein the blade portion of each stick is of a length of about 4¼ inches.

9. A game apparatus as claimed in claim 6 wherein said playing piece is a soft or hard squash ball.

10. A game apparatus as claimed in claim 1 wherein said game surface is visibly divided such that said opposed sections are separated by a common central region therebetween which extends across said game surface, said opposed sections each forming a defensive region adjacent one of said goal areas.

11. A game apparatus as claimed in claim 10 wherein said goals are in end boards and each player must maintain a position behind said respective end board, and wherein each player must maintain his stick in his defensive region or said common central region.

12. A game apparatus as claimed in claim 1 including a net associated with each goal area and supported by the board members, each net is positioned to provide a retaining pocket for said playing piece should it enter the respective net.

13. A game apparatus as claimed in claim 12 wherein said game surface includes a support arrangement supporting said game surface approximately 6 to 14 inches above ground level.

14. A method of playing the game apparatus as claimed in claim 11 wherein each player must maintain two hands on said respective stick.

15. A game apparatus for interactive competition between two opposed players comprising a game surface closed at the sides and ends by upstanding board members with said game surface being divided into at least two opposed sections with each section having a goal area to be defended, each goal area being defined by a port adjacent said upstanding board members, at least two playing sticks with each playing stick having an elongate shaft of a length of about two feet or greater to allow both hands of a player to engage the shaft in spaced relationship with a short blade portion at one end thereof, and a playing piece sized to easily pass through said goal areas and to be moved and directed by said playing sticks, and wherein said game surface is raised from ground level to a height greater than 9 inches and less than 2 feet.

16. A game apparatus as claimed in claim 15 wherein said playing piece is a hollow rubber ball and said game surface between said goal area is of a length of about six feet.

17. A game apparatus as claimed in claim 15 wherein the blade portion of each stick is of a length of about 4 inches.

18. A game apparatus as claimed in claim 15 wherein said shaft is of a length less than three feet.

19. A game apparatus for interactive competition between two opposed players comprising a game surface closed at the sides and ends by upstanding board members with said game surface being divided into at least two opposed sections with each section having a goal area to be defended, each goal area being defined by a port adjacent to said upstanding board members, at least two playing sticks with each playing stick having an elongate shaft of a length of about two feet or greater to allow both hands of a player to engage the shaft in spaced relationship with a short blade portion at one end thereof, and a playing piece sized to easily pass through said goal areas and to be moved and directed by said playing sticks, and wherein said game surface includes a support arrangement supporting said game surface approximately 6 to 14 inches above ground level.

20. A game apparatus as claimed in claim 19 wherein the blade of each playing stick is of a length of about 4 inches and the respective shaft is of a length less than three feet.

* * * * *